US009441400B2

(12) United States Patent
Liau

(10) Patent No.: US 9,441,400 B2
(45) Date of Patent: Sep. 13, 2016

(54) CLOSURE LATCH

(71) Applicant: Wan Lai Liau, Taipei (TW)

(72) Inventor: Wan Lai Liau, Taipei (TW)

( * ) Notice: Subject to any disclaimer, the term of this patent is extended or adjusted under 35 U.S.C. 154(b) by 500 days.

(21) Appl. No.: 14/084,660

(22) Filed: Nov. 20, 2013

(65) Prior Publication Data

US 2015/0137526 A1 May 21, 2015

(51) Int. Cl.

| | |
|---|---|
| ***E05C 1/06*** | (2006.01) |
| ***E05B 63/00*** | (2006.01) |
| ***E05B 3/00*** | (2006.01) |
| *E05C 1/16* | (2006.01) |

(52) U.S. Cl.

CPC ..... *E05B 63/006* (2013.01); *E05B 3/00* (2013.01); *E05C 1/16* (2013.01); *Y10T 292/102* (2015.04)

(58) Field of Classification Search

CPC ..... E05B 1/00; E05B 1/0007; E05B 3/00; E05B 3/003; E05B 3/02; E05B 3/06; E05B 3/08; E05B 3/10

USPC ..... 292/347, 348, 350

See application file for complete search history.

(56) References Cited

U.S. PATENT DOCUMENTS 1,589,525 A * 6/1926 Freysinger ..... E05B 1/06 16/412
1,653,514 A * 12/1927 Schlage ..... E05B 1/0007 292/347
1,847,797 A * 3/1932 Vernooy ..... E05B 3/06 292/348
2,094,982 A * 10/1937 Gerard ..... E05B 1/0007 292/347
2,834,628 A * 5/1958 Paparelli ..... E05B 85/08 292/347
3,471,190 A * 10/1969 Turnbull ..... E05B 3/06 292/348
5,411,303 A * 5/1995 To ..... E05B 3/06 292/357
5,441,318 A * 8/1995 Ghostley ..... E05B 3/04 292/336.3
2008/0252086 A1* 10/2008 Houis ..... E05B 3/00 292/348

* cited by examiner

*Primary Examiner* — Matthew Ing
(74) *Attorney, Agent, or Firm* — Jackson IPG PLLC; Demian K. Jackson

(57) ABSTRACT

A latch comprising a base, a handle, a socket, a nut, a threaded shank, and a hollow shaft is provided. The base includes a central through hole and a side recess. The handle includes a toothed holed end. The socket includes an upper toothed section, a lower extension, an intermediate annular flange, a tab extending outward from the flange, an axial channel through the socket, a top hole on the socket and communicating with the channel, and a shoulder between the channel and the top hole. The nut includes a hexagonal top hole and an internally threaded hole. The threaded shank includes an upper section, a lower section, an adjustment section extending downward from the lower section, and an intermediate annular flange between the upper section and the lower section; and the shaft includes an internally threaded hole.

6 Claims, 9 Drawing Sheets

CLOSURE LATCH

BACKGROUND OF THE INVENTION

1. Field of the Invention

The invention relates to latches and more particularly to a latch for closure e.g., window or door and the latching being capable of adjusting a shaft for accommodating different thicknesses of the frame of a window [or door].

2. Description of Related Art

Typically, thickness of a window or door is between 25 mm and 60 mm. Depth of a lock lever or lock latch mounted into the window or door may vary accordingly.

A conventional window latch is shown in FIGS. 11 and 12, and comprises a base 1C, a socket 2C having a through hole 21C, a screw SC driven through the through hole 21C into an end of a handle 3C, and a shaft 4C of rectangular cross-section having an upper portion complementarily disposed in the through hole 21C. Thus, a turning of the handle 3C can turn the shaft 4C for opening or closing the window.

However, different specifications of the shaft 4C are required in order to accommodate different thicknesses of the frame of a window [or door]. This can increase the manufacturing cost greatly. Thus, the need for improvement still exists.

SUMMARY OF THE INVENTION

It is therefore one object of the invention to provide a latch comprising a base, a handle, a socket, a nut, a threaded shank, and a shaft of rectangular section, wherein the base comprises two end holes, a central through hole, a hole on an upper portion of the through hole, a shoulder between the end hole and the through hole, and a side recess on a lower portion of the through hole; the handle comprises a holed end and teeth on an inner surface of the holed end; the socket comprises an upper toothed section, a lower extension, an intermediate annular flange, a tab extending outward from the flange, an axial channel of rectangular section through a substantial portion of the socket, a circular hole on a top of the socket and communicating with the channel, and a shoulder between the channel and the circular hole; the nut comprises a hexagonal hole on a top, and an internally threaded hole spaced from and directly below the hexagonal hole; the threaded shank comprises an upper section, a lower section, an adjustment section extending downward from the lower section, and an intermediate annular flange between the upper section and the lower section; and the shaft comprises an internally threaded hole; and wherein the socket is inserted through the through hole and the hole until the flange is stopped by the shoulder with the tab received by the recess and the upper toothed section meshed with the teeth, the lower section of the threaded shank is threadedly secured to the internally threaded hole of the shaft, the upper section of the threaded shank is inserted through the channel and the hole until the flange is stopped by the shoulder, the internally threaded hole is secured to the upper section of the threaded shank, a turning of the handle rotates the socket which in turn rotates the shaft, and a rotation of the nut rotates the threaded shank, thereby moving the shaft with respect to the threaded shank.

It is another object of the invention to provide a latch comprising a base, a handle, a socket, a nut, a threaded shank, and a shaft of rectangular section, wherein the base comprises two end holes, a central through hole, a hole on an upper portion of the through hole, a shoulder between the end hole and the through hole, and a side recess on a lower portion of the through hole; the handle comprises a holed end and teeth on an inner surface of the holed end; the socket comprises an upper toothed section, a lower extension, an intermediate annular flange, a tab extending outward from the flange, an axial channel of rectangular section through a substantial portion of the socket, a circular hole on top of the socket and communicating with the channel, and a shoulder between the channel and the circular hole; the nut comprises a hexagonal hole on top, and an internally threaded hole spaced from and directly below the hexagonal hole; the threaded shank comprises an upper section, a lower section, and an adjustment section extending downward from the lower section, and an intermediate annular flange between the upper section and the lower section; and the shaft comprises an internally threaded hole; and wherein the socket is inserted through the through hole and the hole until the flange is stopped by the shoulder with the tab received by the recess and the upper toothed section meshed with the teeth, the lower section of the threaded shank is threadedly secured to the internally threaded hole of the shaft, the upper section of the threaded shank is inserted through the channel and the hole until the flange is stopped by the shoulder, the internally threaded hole is secured to the upper section of the threaded shank, turning of the handle rotates the socket which in turn rotates the shaft, and a rotation of the nut rotates the threaded shank, thereby moving the shaft with respect to the threaded shank; further comprising a base, a handle member, a socket, a nut member, a threaded shank, a plurality of fastening members, and a bolt assembly; wherein the base comprises two end holes for fastening the fastening members, a central through hole, a hole on an upper portion of the through hole, a shoulder between the hole and the through hole, and a side recess on lower portion of the through hole; the handle member comprises a holed end and teeth on an inner surface of the holed end; the socket comprises an upper toothed section, a lower extension, and an intermediate, annular flange, a tab extending outward from the flange, an axial channel of rectangular section through substantial portion of the socket, a circular hole on top of the socket and communicating with the channel, and a shoulder between the channel and the circular hole; the nut member comprises a hexagonal hole on top, and an internally threaded hole spaced from and directly below the hole; the threaded shank comprises an upper section, a lower section, and an adjustment section extending downward from the lower section, and an intermediate, annular flange between the upper section and the lower section; and the bolt assembly comprises a latch bolt and an aperture of rectangular section; and wherein the socket is inserted through the through hole and the hole until the flange is stopped by the shoulder with the tab received by the recess and the upper toothed section meshed with the teeth, the lower section of the threaded shank is threadedly secured to the internally threaded hole of the shaft, the upper section of the threaded shank is inserted through the channel and the hole until the flange is stopped by the shoulder, the shaft is mounted through the aperture, a turning of the handle rotates the socket which in turn rotates the shaft to extend or retract the latch bolt, and a rotation of the nut member rotates the threaded shank, thereby moving the shaft with respect to the threaded shank.

The above and other objects, features and advantages of the invention will become apparent from the following detailed description taken with the accompanying drawings.

DETAILED DESCRIPTION OF THE INVENTION

Figure 1:
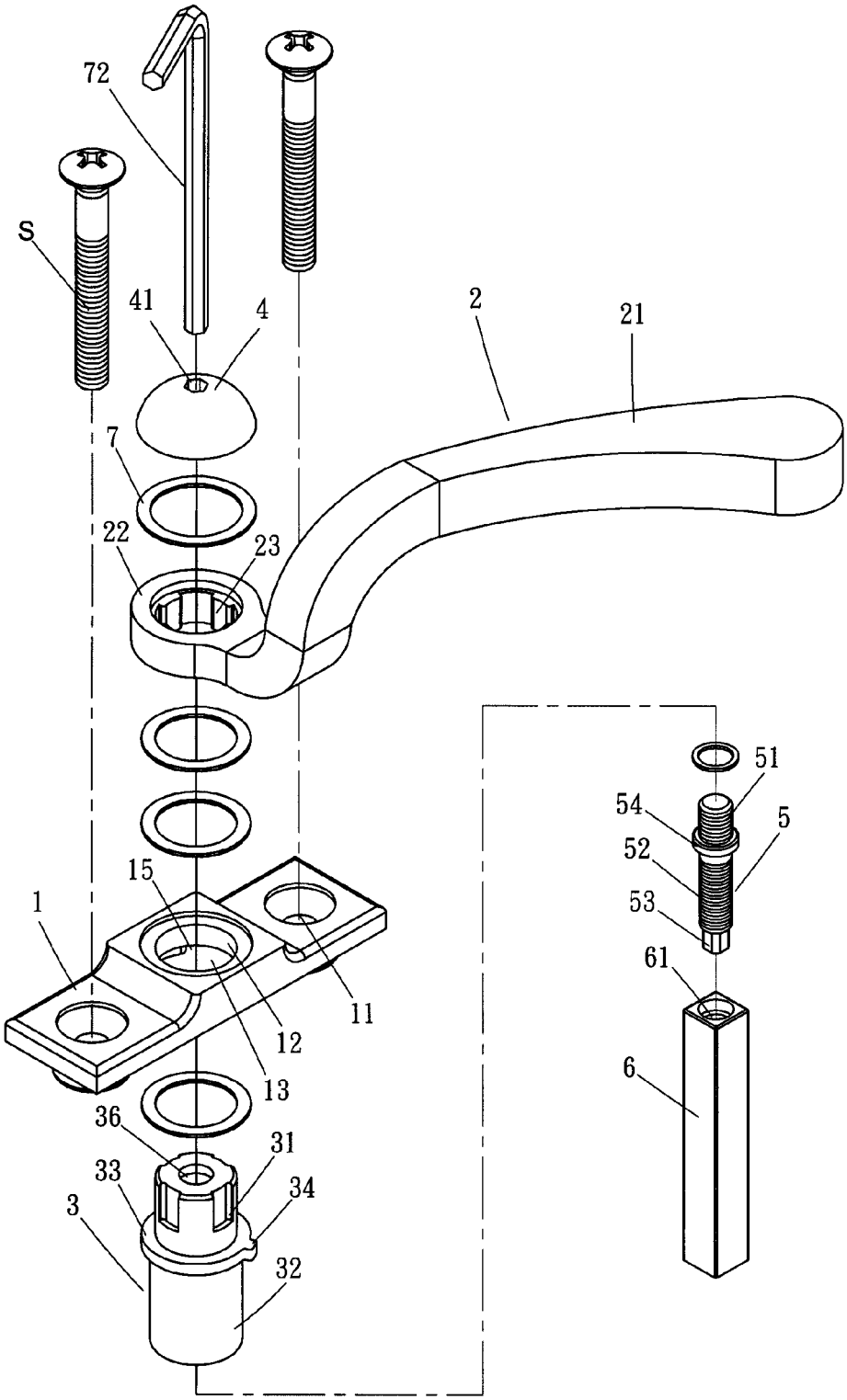
FIG. 1 is an exploded view of a window latch according to a first preferred embodiment of the invention.
Figure 2:
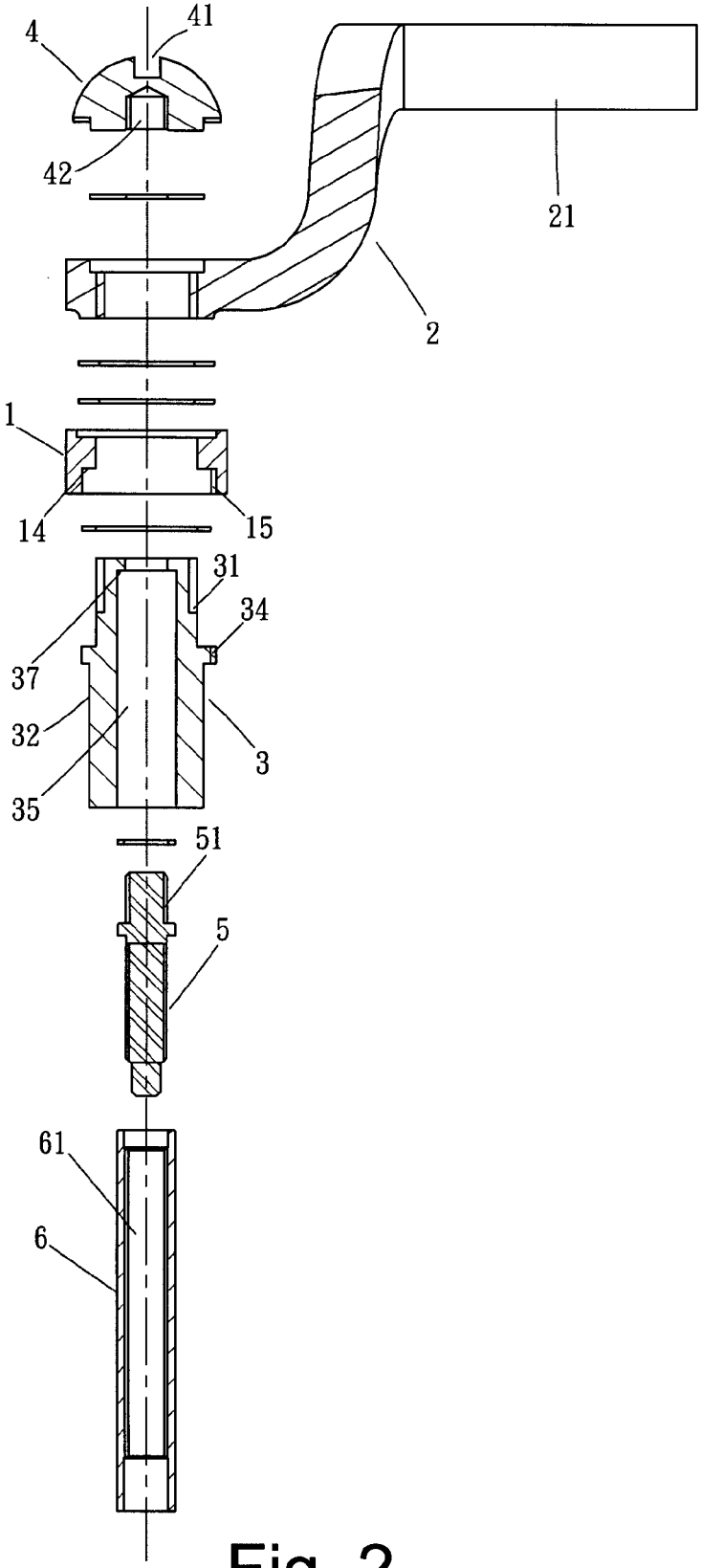
FIG. 2 is a longitudinal sectional view of the window latch yet been assembled.
Figure 3:
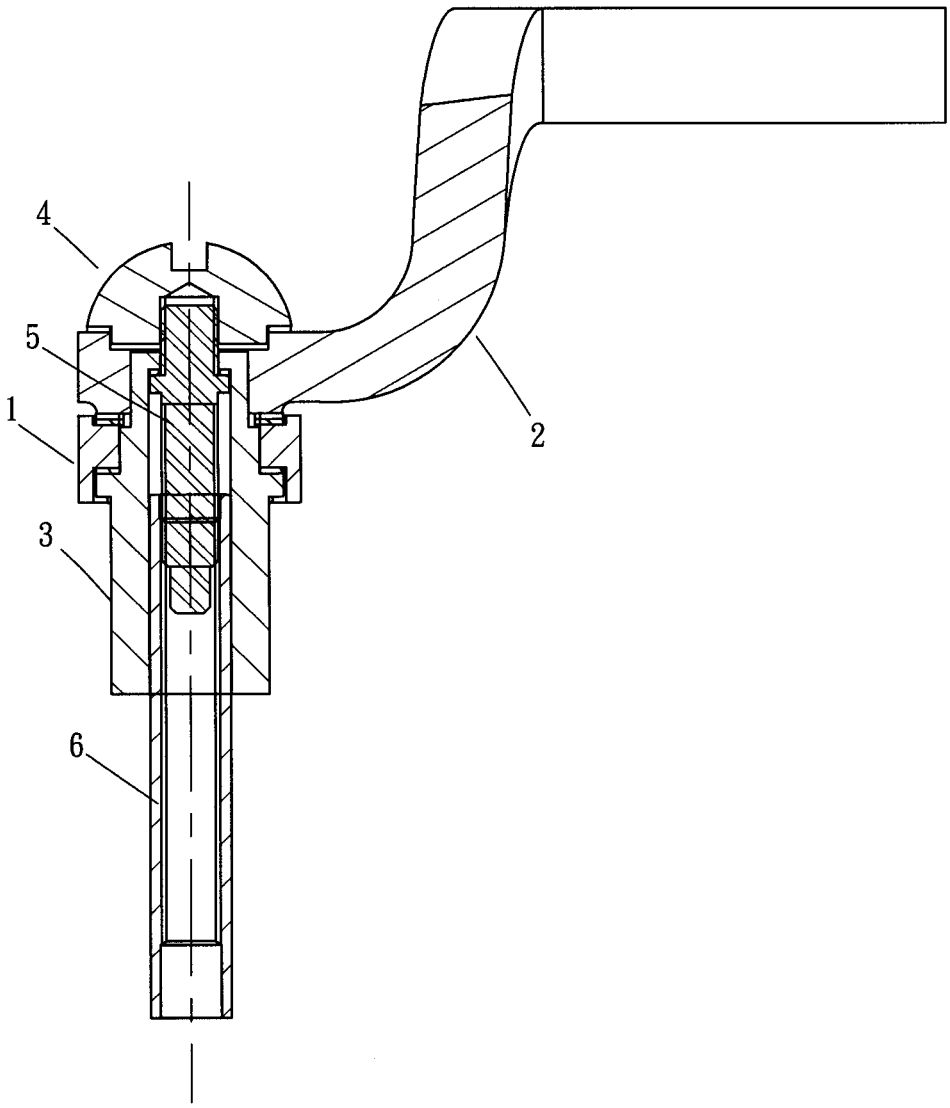
FIG. 3 is a longitudinal sectional view of the window latch of FIG. 2 been assembled.

Referring to FIGS. 1 to 7, a window latch in accordance with the invention comprises a rectangular base 1, a handle 2, a socket 3, a nut 4, a threaded shank 5, a shaft 6 of rectangular section, and a plurality of washers 7 as discussed in detail below.

The base 1 is made of metal and comprises two holes 11 proximate to both ends respectively, a central through hole 13, a hole 12 on an upper portion of the through hole 13, a shoulder 14 between the hole 12 and the through hole 13, and a side recess 15 on a lower portion of the through hole 13. The handle 2 comprises a gripping portion 21, a holed end 22, and teeth 23 on an inner surface of the holed end 22.

The socket 3 comprises an upper toothed section 31, a lower extension 32, an intermediate annular flange 33, a tab 34 extending outward from the flange 33, an axial channel 35 of rectangular section through a substantial portion of the socket 3, a circular hole 36 on a top of the socket 3 and communicating with the channel 35, and a shoulder 37 between the larger channel 35 and the smaller hole 36. The nut 4 has a curved top surface and comprises a hexagonal hole 41 on a top, and an internally threaded hole 42 spaced from and directly below the hole 41.

The threaded shank 5 comprises an upper section 51, a lower section 52, an adjustment section 53 extending downward from the lower section 52, and an intermediate annular flange 54 between the upper section 51 and the lower section 52. The shaft 6 is hollow and comprises an internally threaded hole 61. One washer 7 is clamped between the nut 4 and the holed end 22. Two washers 7 are clamped between the holed end 22 and the hole 12. A washer 7 is clamped against the shoulder 14. A washer 7 is clamped against the flange 54.

Figure 4:
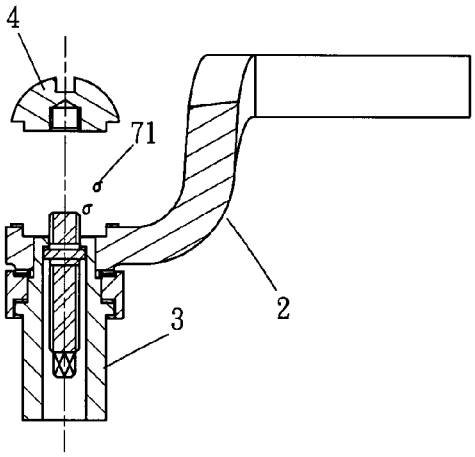
FIG. 4 is a view similar to FIG. 3 with the shaft and the nut removed.
Figure 5:
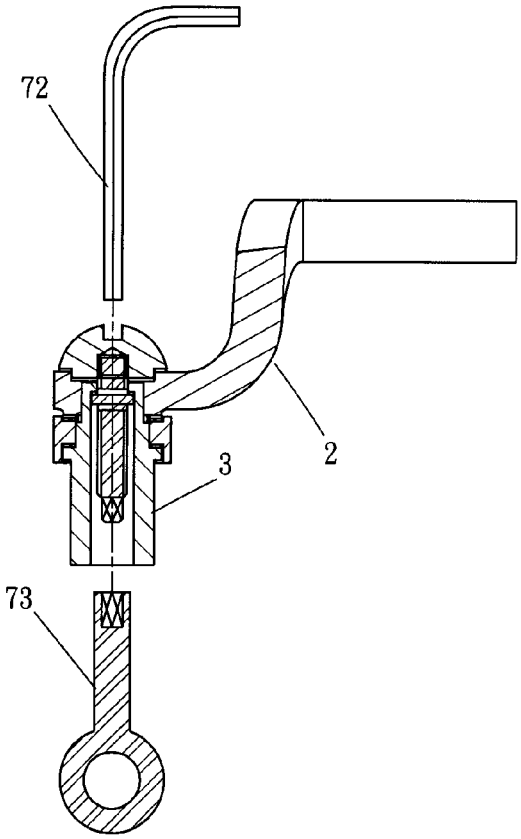
FIG. 5 is a view similar to FIG. 4 with the nut mounted and both a hex key and a socket wrench been adapted to use for adjustment purpose.

In assembly, the socket 3 is inserted through the through hole 13 and the hole 12 until the flange 33 is stopped by the shoulder 14 with the tab 34 received by the recess 15 and the upper toothed section 31 meshed with the teeth 23. The lower section 52 of the threaded shank 5 is threadedly secured to the internally threaded hole 61 of the shaft 6. The upper section 51 of the threaded shank 5 is inserted through the channel 35 and the hole 36 until the flange 54 is stopped by the shoulder 37. As shown in FIG. 4, adhesive 71 is applied onto the upper section 51 of the threaded shank 5 prior to threadedly securing the internally threaded hole 42 to the upper section 51 of the threaded shank 5. As shown in FIG. 5, a hex key 72 has one end inserted into the hole 41 and a top of a socket wrench 73 is put on the extender 53 for fastening adjustment.

Figure 6:
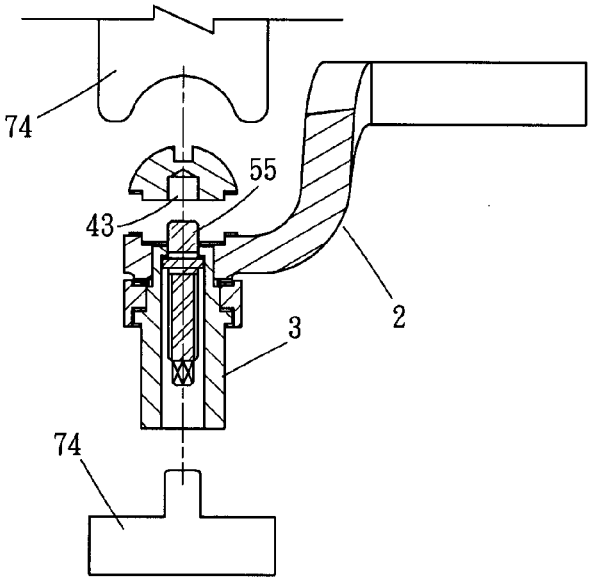
FIG. 6 is a view similar to FIG. 4 with two dies been used to secure the nut to the window latch in another configuration of the invention.

As shown in FIG. 6, in another configuration the internally threaded hole 42 is replaced with a hole 43 and the threaded upper section 51 is replaced with a smooth upper section 55 fitted in the hole 43. Further, one die 74 is used to fasten them together from above and the other die 74 is used to fasten the extender 53 from below.

Figure 7:
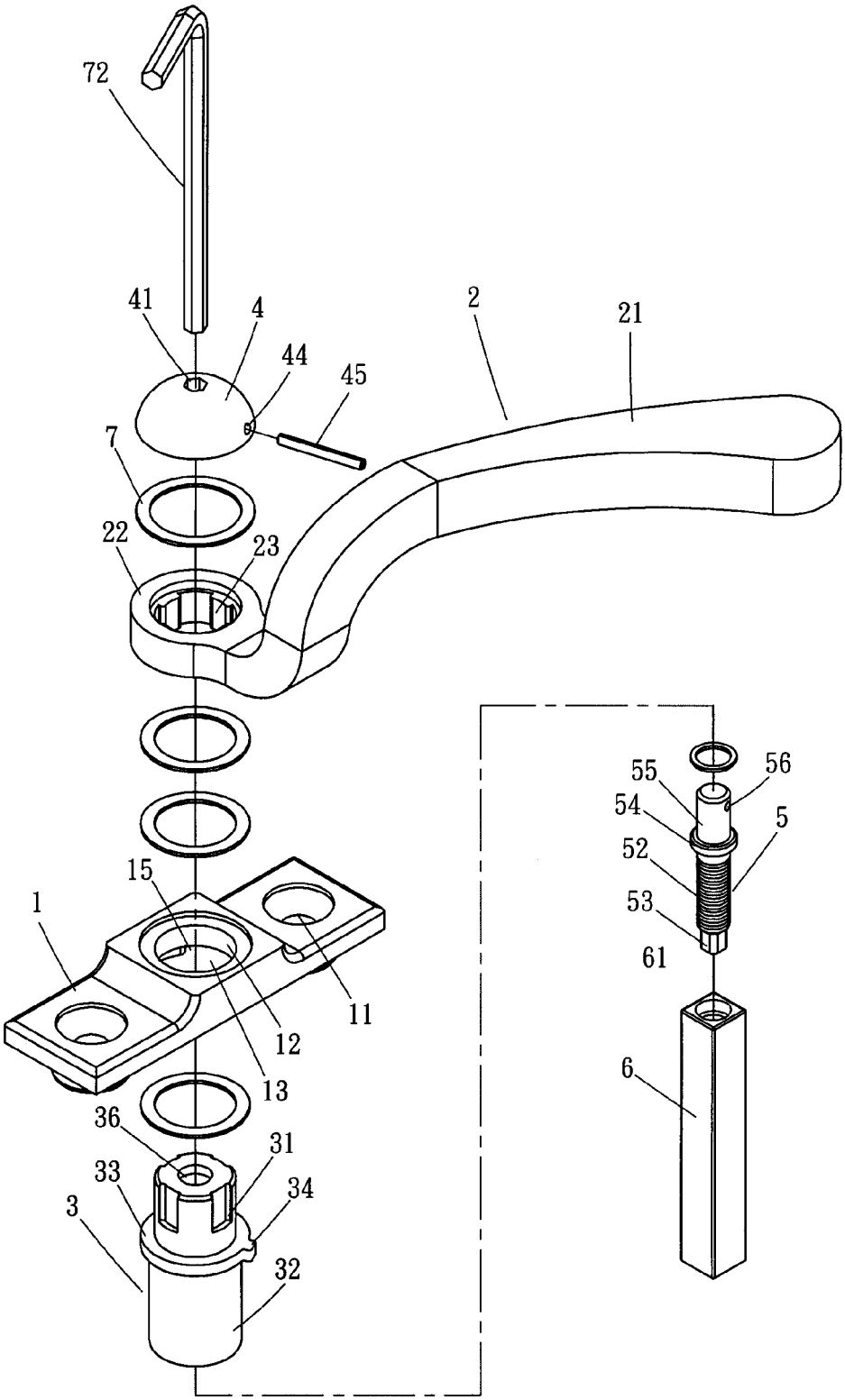
FIG. 7 is an exploded view of a window latch according to a second preferred embodiment of the invention.

As shown in FIG. 7, alternatively, a transverse through hole 44 is provided in the nut 4, a transverse through hole 56 is provided in the upper section 55, and a lock pin 45 is inserted through the through holes 44 and 56 to fasten the nut 4 and the threaded shank 5 together.

Two screws S are driven through the holes 11 into the frame of a window [not shown] for mounting the latch on the window. Further, the shaft 6 is mounted in the frame of the window. Thus, a turning of the handle 2 can rotate the socket 3 which in turn rotate the shaft 6 so as to lock or unlock the window. Further, an individual may insert one end of a hex key 72 into the hole 41 and rotate the hex key 72 to drive the nut 4 which in turn rotates the threaded shank 5. As such, the shaft 6 retracts or extends for length adjustment. As a result, the purpose of accommodating different thicknesses of the frame of a window is achieved.

Figure 8:
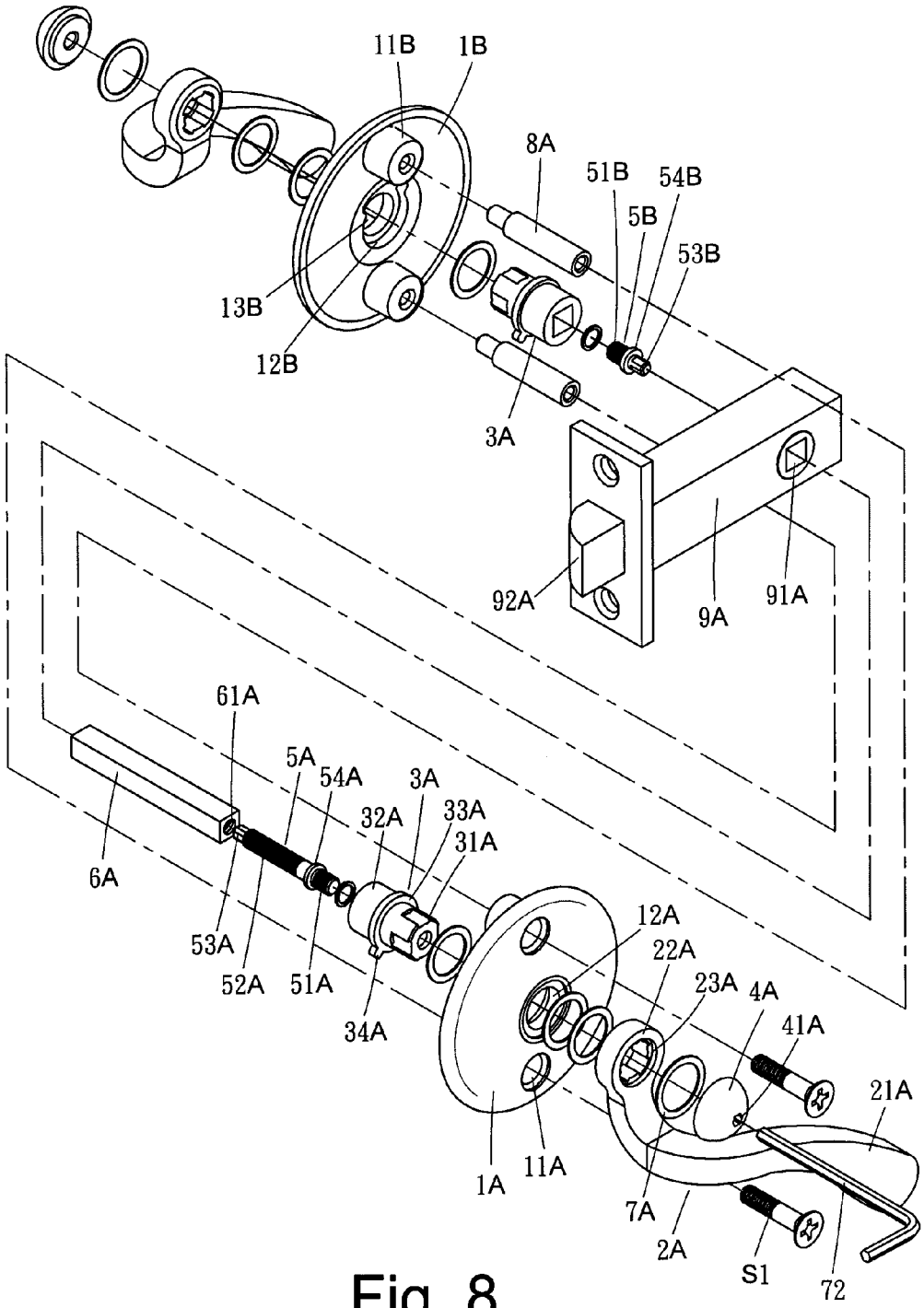
FIG. 8 is an exploded view of a door lock according to the invention.
Figure 9:
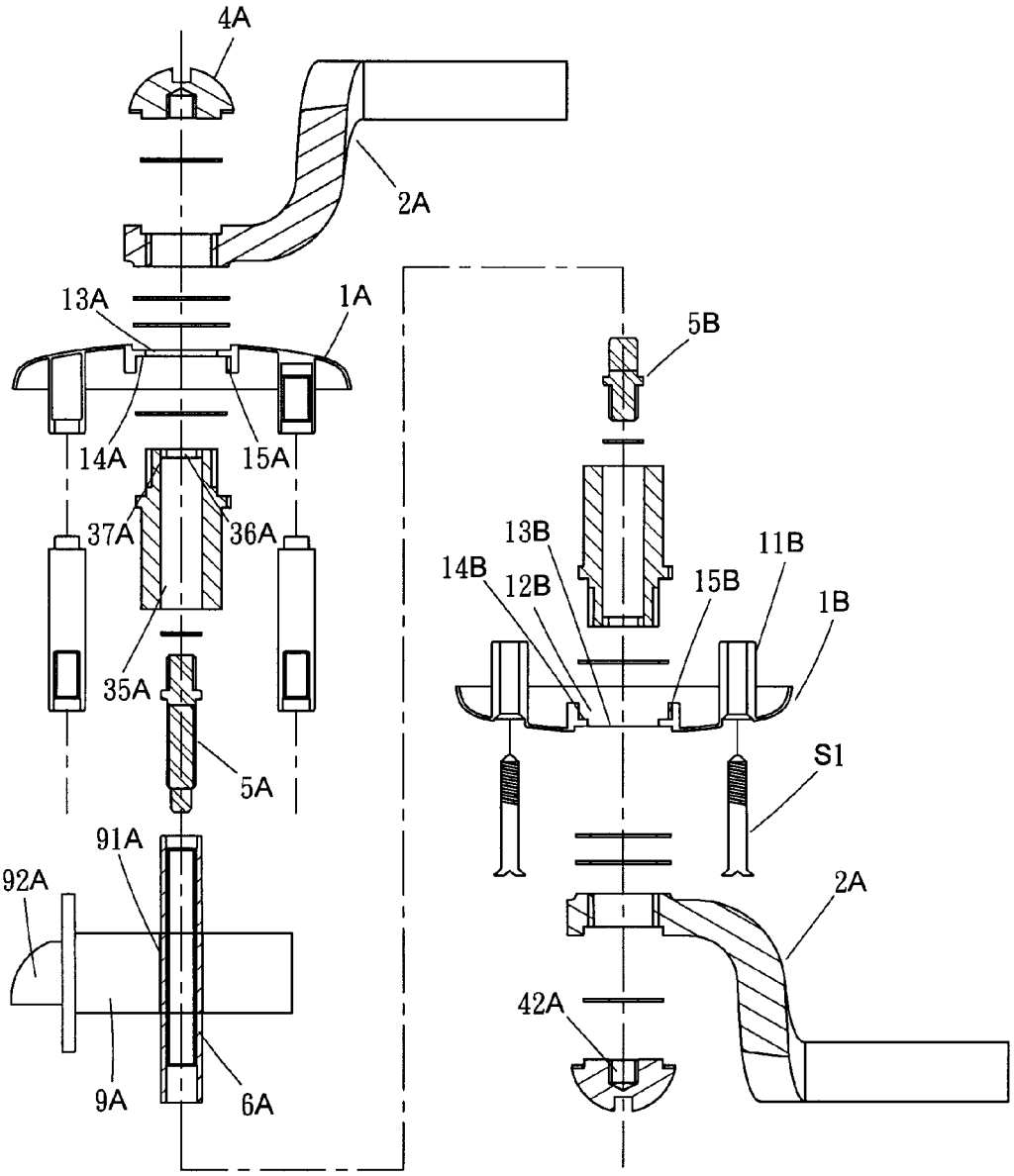
FIG. 9 is a longitudinal sectional view of the door latch yet been assembled.
Figure 10:
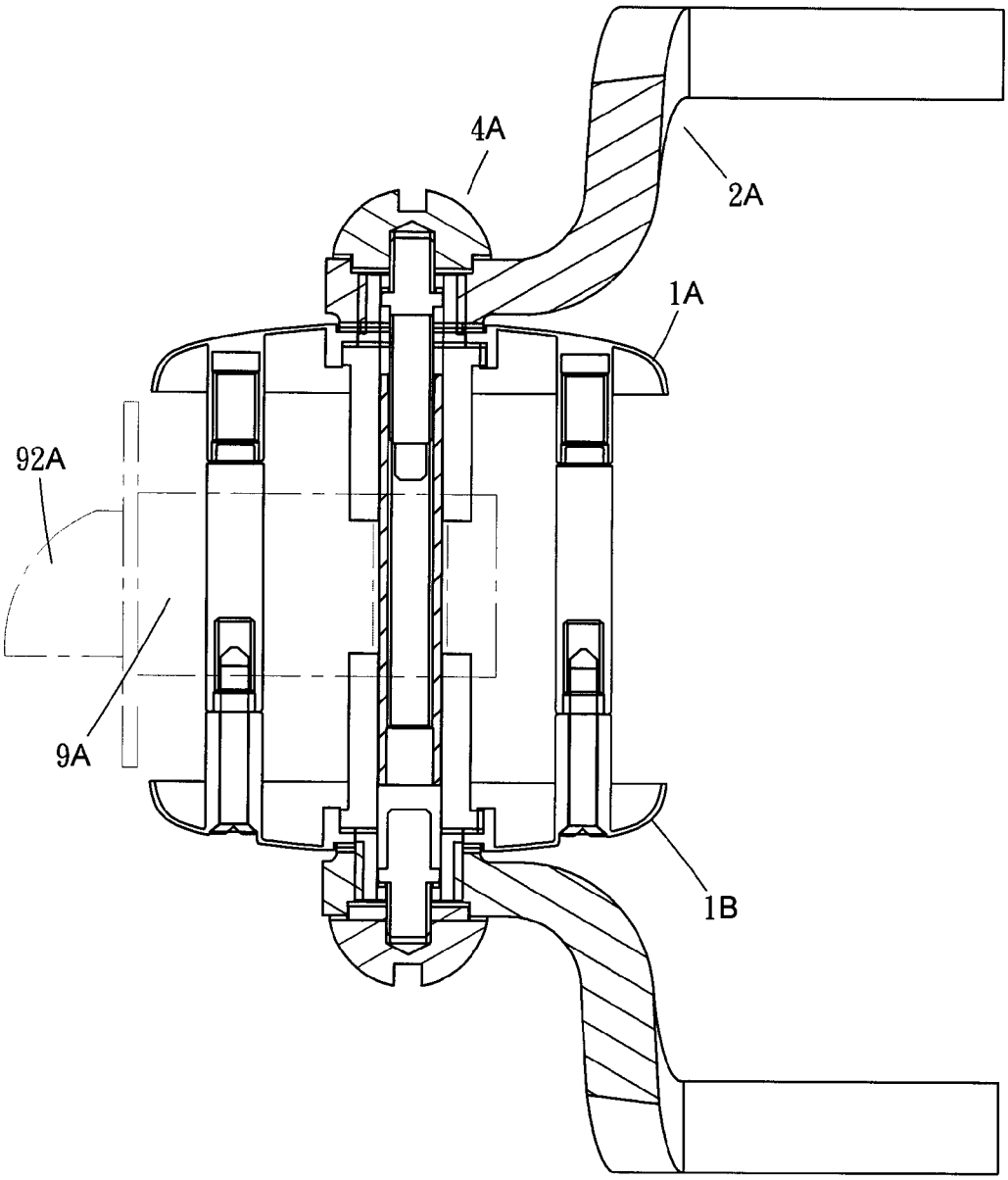
FIG. 10 is a longitudinal sectional view of the door latch of FIG. 9 been assembled.
Figure 11:
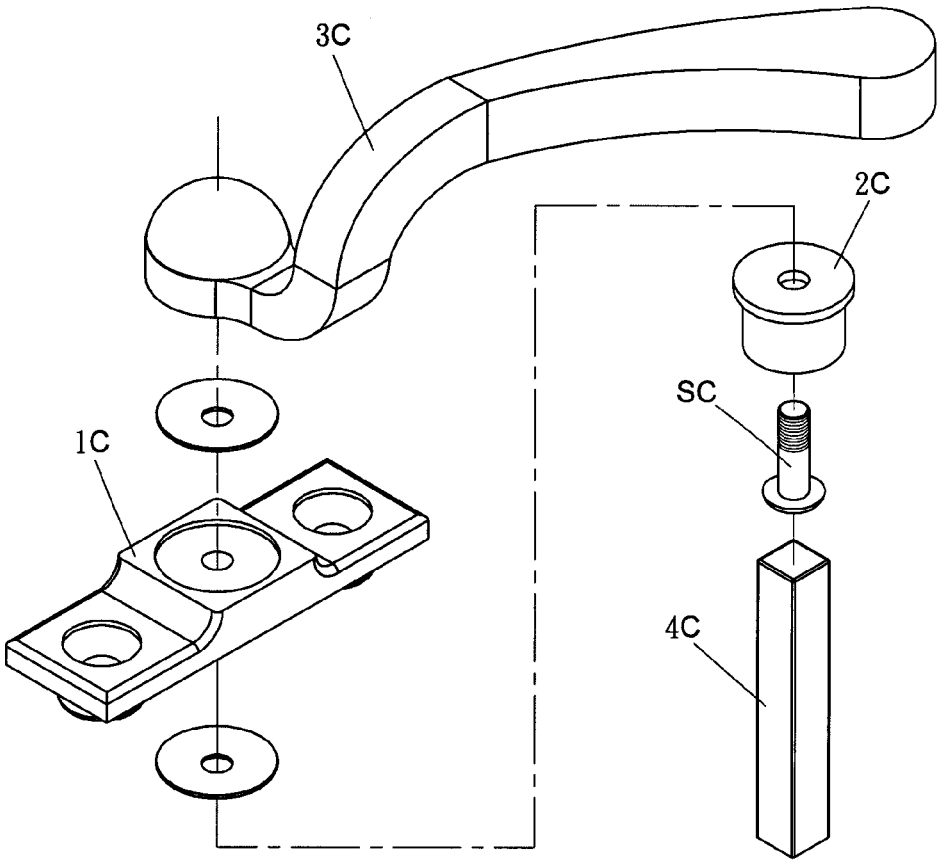
Prior Art Fig. 11
FIG. 11 is an exploded view of a conventional window latch.
Figure 12:
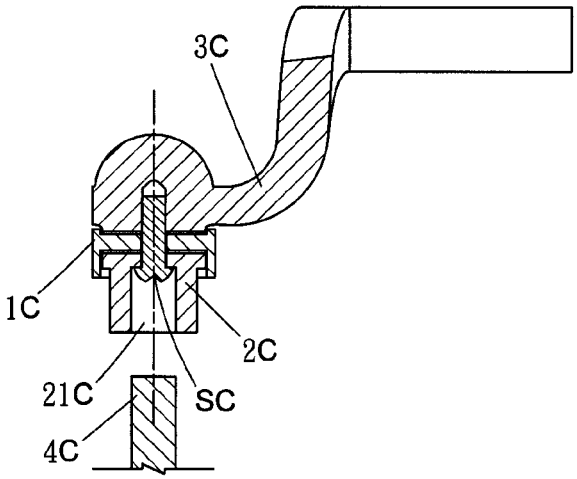
Prior Art Fig. 12
FIG. 12 is a longitudinal sectional view of the partly assembled window latch of FIG. 11.

Referring to FIGS. 8 to 10, a door lock in accordance with the invention is shown and comprises a rectangular base 1A, a handle 2A, a socket 3A, a nut 4A, a threaded shank 5A, a shaft 6A of rectangular section, and a plurality of washers 7A as discussed in detail below.

The base 1A is made of metal and comprises two holes 11A proximate to both ends respectively, a central through hole 13A, a hole 12A on an upper portion of the through hole 13A, a shoulder 14A between the hole 12A and the through hole 13A, and a side recess 15A on a lower portion of the through hole 13A. The handle 2A comprises a gripping portion 21A, a holed end 22A, and teeth 23A on an inner surface of the holed end 22A.

The socket 3A comprises an upper toothed section 31A, a lower extension 32A, an intermediate annular flange 33A, a tab 34A extending outward from the flange 33A, an axial channel 35A of rectangular section through a substantial portion of the socket 3A, a circular hole 36A on a top of the socket 3A and communicating with the channel 35A, and a shoulder 37A between the larger channel 35A and the smaller hole 36A. The nut 4A has a curved top surface and comprises a hexagonal hole 41A on a top, and an internally threaded hole 42A spaced from and directly below the hole 41A.

The threaded shank 5A comprises an upper section 51A, a lower section 52A, an adjustment section 53A extending downward from the lower section 52A, and an intermediate annular flange 54A between the upper section 51A and the lower section 52A. The shaft 6A is hollow and comprises an internally threaded hole 61A. One washer 7A is clamped between the nut 4A and the holed end 22A. Two washers 7A are clamped between the holed end 22A and the hole 12A. A washer 7A is clamped against the shoulder 14A. A washer 7A is clamped against the flange 54A.

In assembly, the socket 3A is inserted through the through hole 13A and the hole 12A until the flange 33A is stopped by the shoulder 14A with the tab 34A received by the recess 15A and the upper toothed section 31A meshed with the teeth 23A. The lower section 52A of the threaded shank 5A is threadedly secured to the internally threaded hole 61A of the shaft 6A. The upper section 51A of the threaded shank 5A is inserted through the channel 35A and the hole 36A until the flange 54A is stopped by the shoulder 37A.

The door lock further comprises a rectangular base 1B, a handle 2A, a socket 3B, a nut 4A, a threaded shank 5B, and a plurality of fastening members 8A discussed in detail below.

The base 1B is made of metal and comprises two holes 11B proximate to both ends respectively for fastening the fastening members 8A, a central through hole 13B, a hole 12B on an upper portion of the through hole 13B, a shoulder 14B between the hole 12B and the through hole 13B, and a side recess 15B on a lower portion of the through hole 13B. The handle 2A comprises a gripping portion 21B, a holed end 22B, and teeth 23B on an inner surface of the holed end 22B.

The socket 3B comprises an upper toothed section 31B, a lower extension 32B, an intermediate annular flange 33B, a tab 34B extending outward from the flange 33B, an axial channel 35B of rectangular section through a substantial portion of the socket 3B, a circular hole 36B on a top of the socket 3B and communicating with the channel 35B, and a shoulder 37B between the larger channel 35B and the smaller hole 36B. The nut 4A has a curved top surface and comprises a hexagonal hole 41A on a top, and an internally threaded hole 42A spaced from and directly below the hole 41A.

The threaded shank 5B comprises an upper section 51B, a lower section 52B, an adjustment section 53B extending downward from the lower section 52B, and an intermediate annular flange 54B between the upper section 51B and the lower section 52B.

In assembly, the socket 3B is inserted through the through hole 13B and the hole 12B until the flange 33B is stopped by the shoulder 14B with the tab 34B received by the recess 15B and the upper toothed section 31B meshed with the teeth 23B. The lower section 52B of the threaded shank 5B is threadedly secured to the internally threaded hole 61A of the shaft 6A. The upper section 51B of the threaded shank 5B is inserted through the channel 35B and the hole 36B until the flange 54B is stopped by the shoulder 37B.

A bolt assembly 9A is mounted in an edge of a door [not shown] and comprises a latch bolt 9A extending out of a face plate, and an aperture 91A of rectangular section. The shaft 6A is mounted through the aperture 91A. Two screws S1 are driven through the holes 11A into the frame of the door for mounting the latch on the door. Thus, a turning of the handle 2A can rotate the socket 3A which in turn rotate the shaft 6A. Further, the shaft 6A extends the latch bolt 9A to lock the door or retracts the latch bolt 9A to unlock the door. Further, an individual may insert one end of a hex key 72 into the hole 41A and rotate the hex key 72 to drive the nut 4A disposed externally of the door. And in turn, the threaded shank 5A is rotated. As such, the shaft 6A retracts or extends for length adjustment. As a result, the purpose of accommodating different thicknesses of the frame of a window is achieved. The individual may insert one end of a hex key 72 into the hole 41A and rotate the hex key 72 to drive the nut 4A disposed internally of the door. And in turn, the threaded shank 5B is rotated. However, the shaft 6A will not rotate [i.e., idle].

While the invention has been described in terms of preferred embodiments, those skilled in the art will recognize that the invention can be practiced with modifications within the spirit and scope of the appended claims.

What is claimed is:

1. A latch comprising a base 1, a handle 2, a socket 3, a nut 4, a threaded shank 5, and a shaft 6 of rectangular section, wherein the base 1 comprises two end holes 11, a central through hole 13, a hole 12 on an upper portion of the through hole 13, a shoulder 14 between the end hole 12 and the through hole 13, and a side recess 15 on a lower portion of the through hole 13;

the handle 2 comprises a holed end 22 and teeth 23 on an inner surface of the holed end 22;

the socket 3 comprises an upper toothed section 31, a lower extension 32, an intermediate annular flange 33, a tab 34 extending outward from the flange 33, an axial channel 35 of rectangular section through a substantial portion of the socket 3, a circular hole 36 on a top of the socket 3 and communicating with the channel 35, and a shoulder 37 between the channel 35 and the circular hole 36;

the nut 4 comprises a hexagonal hole 41 on a top, and an internally threaded hole 42 spaced from and directly below the hexagonal hole 41;

the threaded shank 5 comprises an upper section 51, a lower section 52, an adjustment section 53 extending downward from the lower section 52, and an intermediate annular flange 54 between the upper section 51 and the lower section 52; and the shaft 6 comprises an internally threaded hole 61; and wherein the latch is configured to be capable of the following:

the socket 3 is inserted through the through hole 13 and the hole 12 until the flange 33 is stopped by the shoulder 14 with the tab 34 received by the recess 15 and the upper toothed section 31 meshed with the teeth 23, the lower section 52 of the threaded shank 5 is threadedly secured to the internally threaded hole 61 of the shaft 6, the upper section 51 of the threaded shank 5 is inserted through the channel 35 and the hole 36 until the flange 54 is stopped by the shoulder 37, the internally threaded hole 42 is secured to the upper section 51 of the threaded shank 5, such that a turning of the handle 2 rotates the socket 3 which in turn rotates the shaft 6, and a rotation of the nut 4 rotates the threaded shank 5, thereby moving the shaft 6 with respect to the threaded shank 5.

2. The latch of claim 1, wherein the internally threaded hole 42 is replaced with a hole 43 and the threaded upper section 51 is replaced with an unthreaded upper section 55 fitted in the hole 43, and further comprising a first die 74 for fastening the nut 4 and the threaded shank 5 together, and a second die 74 for fastening the extender 53.

3. The latch of claim 2, wherein a transverse through hole 44 is provided in the nut 4, a transverse through hole 56 is provided in the unthreaded upper section 55, and a lock pin 45 is provided to insert through the transverse through holes 44, 56 to fasten the nut 4 and the threaded shank 5 together.

4. A latch comprising a base 1A, a handle 2A, a socket 3A, a nut 4A, a threaded shank 5A, and a shaft 6A of rectangular section, wherein the base 1A comprises two end holes 11A, a central through hole 13A, a hole 12A on an upper portion of the through hole 13A, a shoulder 14A between the end hole 12A and the through hole 13A, and a side recess 15A on a lower portion of the through hole 13A;

the handle 2A comprises a holed end 22A and teeth 23A on an inner surface of the holed end 22A;

the socket 3A comprises an upper toothed section 31A, a lower extension 32A, an intermediate annular flange 33A, a tab 34A extending outward from the flange 33A, an axial channel 35A of rectangular section through a substantial portion of the socket 3A, a circular hole 36A on a top of the socket 3A and communicating with the channel 35A, and a shoulder 37A between the channel 35A and the circular hole 36A;

the nut 4A comprises a hexagonal hole 4A1 on a top, and an internally threaded hole 42A spaced from and directly below the hexagonal hole 41A;

the threaded shank 5A comprises an upper section 51A, a lower section 52A, an adjustment section 53A extending downward from the lower section 52A, and an intermediate annular flange 54A between the upper section 51A and the lower section 52A; and the shaft 6A comprises an internally threaded hole 61A; and wherein the latch is configured to be capable of the following:

the socket 3A is inserted through the through hole 13A and the hole 12A until the flange 33A is stopped by the shoulder 14A with the tab 34A received by the recess 15A and the upper toothed section 31A meshed with the teeth 23A, the lower section 52A of the threaded shank 5A is threadedly secured to the internally threaded hole 61A of the shaft 6A, the upper section 51A of the threaded shank 5A is inserted through the channel 35A and the hole 36A until the flange 54A is stopped by the shoulder 37A, the internally threaded hole 42A is secured to the upper section 51A of the threaded shank 5A, such that a turning of the handle 2A rotates the socket 3A which in turn rotates the shaft 6A, and a rotation of the nut 4A rotates the threaded shank 5A, thereby moving the shaft 6A with respect to the threaded shank 5A;

the latch further comprising a base 1B, a handle member 2A, a socket 3B, a nut member 4A, a threaded shank 5B, a plurality of fastening members 8A, and a bolt assembly 9A;

wherein the base 1B comprises two end holes 11B for fastening the fastening members 8A, a central through hole 13B, a hole 12B on an upper portion of the through hole 13B, a shoulder 14B between the hole 12B and the through hole 13B, and a side recess 15B on a lower portion of the through hole 13B;

the handle member 2A comprises a holed end 22A and teeth 23A on an inner surface of the holed end 22A;

the socket 3B comprises an upper toothed section 31B, a lower extension 32B, an intermediate annular flange 33B, a tab 34B extending outward from the flange 33B, an axial channel 35B of rectangular section through a substantial portion of the socket 3B, a circular hole 36B on a top of the socket 3B and communicating with the channel 35B, and a shoulder 37B between the channel 35B and the circular hole 36B;

the nut member 4A comprises a hexagonal hole 41A on a top, and an internally threaded hole 42A spaced from and directly below the hole 41A;

the threaded shank 5B comprises an upper section 51B, a lower section 52B, an adjustment section 53B extending downward from the lower section 52B, and an intermediate annular flange 54B between the upper section 51B and the lower section 52B; and the bolt assembly 9A comprises a latch bolt 9A and an aperture 91A of rectangular section; and wherein the latch is further configured to be capable of the following:

the socket 3B is inserted through the through hole 13B and the hole 12B until the flange 33B is stopped by the shoulder 14B with the tab 34B received by the recess 15B and the upper toothed section 31B meshed with the teeth 23B, the lower section 52B of the threaded shank 5B is threadedly secured to the internally threaded hole 61A of the shaft 6A, the upper section 51B of the threaded shank 5B is inserted through the channel 35B and the hole 36B until the flange 54B is stopped by the shoulder 37B, the shaft 6A is mounted through the aperture 91A, such that a turning of the handle 2A rotates the socket 3A which in turn rotates the shaft 6A to extend or retract the latch bolt 9A, and a rotation of the nut member 4 rotates the threaded shank 5B, thereby moving the shaft 6A with respect to the threaded shank 5B.

5. The latch of claim 4, wherein the internally threaded hole 42A is replaced with a hole 43 and the threaded upper section 51A is replaced with an unthreaded upper section 55 fitted in the hole 43, and further comprising a first die 74 for fastening the nut member 4A and the threaded shank 5A together, and a second die 74 for fastening the extender 53A.

6. The latch of claim 5, wherein a transverse through hole 44A is provided in the nut member 4A, a transverse through hole 56 is provided in the unthreaded upper section 55, and a lock pin 45 is provided to insert through the transverse through holes 44A, 56A to fasten the nut member 4A and the threaded shank 5 together.

* * * * *